US012194528B2

(12) United States Patent
Han

(10) Patent No.: US 12,194,528 B2
(45) Date of Patent: Jan. 14, 2025

(54) SHRINK-FITTING PROCESS FOR MAKING AN EROSION AND WEAR RESISTANT SHOT CHAMBER FOR DIE CASTING APPLICATIONS

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 31 days.

(21) Appl. No.: 18/094,469

(22) Filed: Jan. 9, 2023

(65) Prior Publication Data

US 2023/0150016 A1 May 18, 2023

Related U.S. Application Data

(63) Continuation-in-part of application No. 16/926,714, filed on Jul. 12, 2020, now Pat. No. 11,577,304.

(51) Int. Cl.

| | |
|---|---|
| ***B22D 19/00*** | (2006.01) |
| ***B22D 17/20*** | (2006.01) |
| ***B22D 17/22*** | (2006.01) |
| ***C23C 28/00*** | (2006.01) |

(52) U.S. Cl.

CPC ..... *B22D 17/2023* (2013.01); *B22D 17/2209* (2013.01); *B22D 19/0081* (2013.01); *C23C 28/321* (2013.01); *C23C 28/3455* (2013.01)

(58) Field of Classification Search

CPC ..... B22D 17/20; B22D 17/2023; B22D 17/2209; B22D 19/00; B22D 19/0081; C23C 28/321; C23C 28/3455

USPC ..... 164/14, 138, 75, 100, 113

See application file for complete search history.

(56) References Cited

U.S. PATENT DOCUMENTS 11,577,304 B2 * 2/2023 Han ..... B22D 17/2023
2016/0311015 A1 * 10/2016 Kwang et al. ..... B22D 17/2023

FOREIGN PATENT DOCUMENTS

JP 2002-59251 A * 2/2002 ..... B22D 17/20

OTHER PUBLICATIONS

Machine translation of JP 2002-59251 A (Year: 2002).*

* cited by examiner

*Primary Examiner* — Kevin P Kerns

(57) ABSTRACT

A process of forming an erosion, oxidation, and wear resistant shot chamber, either a gooseneck or a shot sleeve, is provided. The process utilizes a shrink fitting process for forming a one-piece shot chamber having a liner bonded to the bulk portion of the shot chamber. Channels of predetermined shape and layout are built on the tubular external surface of the liner for facilitating thermal management of the shot chamber during die casting operations.

17 Claims, 3 Drawing Sheets

SHRINK-FITTING PROCESS FOR MAKING AN EROSION AND WEAR RESISTANT SHOT CHAMBER FOR DIE CASTING APPLICATIONS

CROSS-REFERENCE TO RELATED APPLICATIONS

The present U.S. patent application is a divisional and a continuation-in-part application of U.S. Pat. No. 11,577,304 filed Jul. 12, 2020. The relevant contents of this prior application are hereby incorporated by reference (in its entirety) into the present disclosure.

FIELD OF THE INVENTION

The present invention relates to die casting, more specifically, to an erosion and wear resistant gooseneck and shot chamber for die casting of aluminum alloys.

BACKGROUND OF THE INVENTION

Die casting, also termed as high pressure die casting (HPDC), is a widely-used process that entails the injection of a molten metal into a die cavity under high pressure. The metal, commonly aluminum, magnesium, zinc, their alloys, and sometimes copper, titanium, and their alloys, is transported into a chamber containing a cylindrical channel connected to the die cavity, and then is injected with a piston from the chamber to the die cavity, where it solidifies and forms a solid component. Die casting is generally considered to be a cost-effective process capable of producing precision (net-shape) products at high production rates. Currently, die casting processes are used to produce over 70% of the annual tonnage of all aluminum castings in the United States.

There are two kinds of die casting processes: hot-chamber and cold-chamber die casting. An exemplary hot-chamber die casting process is illustrated in FIG. 1. The hot-chamber die casting process uses a "gooseneck" as the chamber containing a cylindrical channel connected to the die cavity. Part of the gooseneck is submerged into the molten metal in a pot or a holding furnace so that the chamber is hot. A reciprocating plunger in the cylindrical channel draws the molten metal in and injects it into the mold cavity through a nozzle. The injection system for hot-chamber die casting consists of a gooseneck, plunger, and a nozzle.

The cold-chamber process, shown in FIG. 2, involves pouring hot metal into a cold shot chamber or shot sleeve containing a cylindrical channel and injecting it using a ram or a plunger into the die cavity. The injection system for cold-chamber die casting consists of a plunger or ram, and a shot sleeve.

The internal surface of the chamber, either a gooseneck or a shot sleeve, is impacted by the corrosive hot metal as it is drawn in or poured in at relatively high speed. The plunger slides against the internal surfaces of the chamber at high temperatures as well. Consequently, the chamber at its internal surface suffers severe erosion by the corrosive molten metal and wear by the plunger. The chamber material, providing the internal surfaces of the chamber, has to withstand both erosion and wear. The internal surface is the working surface for such a chamber.

The present invention relates to minimizing erosion and wear of the shot chamber, and more broadly, for die tooling, including but not limited to the gooseneck, nozzle, shot sleeve, plunger, ladle, and inserts in die or mold including pins for forming holes in a casting. Die tooling components all have working surfaces in contact with the corrosive molten metal flowing over them at fairly high speeds.

Traditionally, die tooling is made of hot work steels. H13 steel is used widely in the United States. Shot sleeve is made of H13. A gooseneck is made of either cast iron or cast steel. These die tooling components are expensive to make. The service life of die tooling is vital to the competitiveness of the industry.

Erosion of the gooseneck in molten aluminum is so severe that hot chamber die casting process is not commercially used for making aluminum castings. Attempts have been made to use refractory ceramic materials for making the gooseneck. For example, U.S. Pat. No. 3,067,146 to Gottfried, U.S. Pat. No. 3,652,072 to Lewis, European Patent No. 0827793 to Miki et al, and Taiwan Patent Document No. 201529204 to Eguchi et al. disclose using ceramic goosenecks for aluminum die casting. However, hot-chamber aluminum die casting systems that utilize ceramic liners for the gooseneck or use ceramic materials for the entirety of the gooseneck have not found wide applications because of high financial costs and poor service life of the ceramic components. Ceramic materials conventionally used for such purposes have had issues with thermal fatigue. Also the relatively low tensile properties and brittleness of ceramic materials have resulted in goosenecks prone to damage during die casting operation. U.S. patent application Ser. No. 15/463,345 by Han et al. discloses the use of refractory metals for the liner in a gooseneck. No protection of the liner is discussed and no relationship between the liner and the bulk materials of the gooseneck is defined. A thin refractory metal liner without proper protection cannot survive long in an aggressive oxidation, erosion, and wear environment.

Refractory metals have high melting points and excellent thermal fatigue resistance. They are resistant to erosion [1-2] by molten aluminum but are vulnerable to rapid oxidation at elevated temperatures. At temperatures as low as 500° C., oxidation is significant. By 1100° C., the low oxidation resistance of refractory metals can preclude completely their use in air [3]. Also, the hardness of the refractory metals is much lower than H13 steel. Alloying of the refractory metals improves their hardness to some extent but minimally increases their corrosion resistance [4]. Liners used in the gooseneck have to be not only erosion resistant but also oxidation and wear resistant.

Erosion of steels in molten aluminum is also a severe issue in cold-chamber die casting [1, 5-7] where H13 steel is usually used for the shot chamber or shot sleeve of a one-piece structure. This is especially true for cold-chamber die casting of structural aluminum alloys because these alloys contain low iron content. Erosion of die tooling steels in molten aluminum can be reduced by lowering the temperature of the die tooling to a given temperature of the molten aluminum [5, 7]. However, there is an uneven or nonsymmetrical temperature distribution in the shot sleeve during die casting operation. When hot molten metal is poured into the shot sleeve, the portion of the shot sleeve under the pour hole is the hottest. Furthermore, the molten metal does not entirely fill the shot chamber but lies or pools along the bottom of the sleeve prior to the commencement of the forward plunger stroke. The portion of the shot sleeve in direct contact with the molten metal is hotter and erodes faster than the other portion of the shot sleeve. Uneven temperature distribution leads to uneven erosion and thermal distortion of the shot sleeve. To reduce uneven temperature distribution, holes are usually drilled into a shot sleeve to form channels that accommodate means of cooling or heating locally. The drilling operation is capable of only forming straight channels. Forming shapes of the channel other than a hole in a shot sleeve is desired but is not achievable.

To extend the service life of a shot chamber, interchangeable liner is used to form the working surface of the shot chamber of two-piece structure. The liner, if damaged by erosion or wear, can be replaced so that the bulk of the shot chamber can be reused.

U.S. Pat. No. 9,114,455 to Donahue et al discloses an improved shot sleeve cold-chamber for die casting of low-iron aluminum silicon alloys and a method for making the shot sleeve of a two-piece structure. The shot sleeve includes an erosion resistant liner that tightly fits with the bulk H13 steel within a small tolerance. The liner is selected from refractory metals including titanium, tungsten, molybdenum, ruthenium, tantalum, niobium etc. The shot sleeve made using this invention lasts longer than that of H13 but there are still a number of issues. The liners only tightly fit with the bulk steel in which there is no bond between them. Consequently, thermal distortion is an issue. Thick liners have to be used in order to reduce thermal distortion but the refractory metals are expensive. Oxidation of the refractory metal liner is another issue. Metal loss on the internal surface of the liner opposite to the pour hole is observed. Such metal loss leads to dimension change as well. Furthermore, the low hardness of the refractory metal results in wear and scoring on the internal surface of the liner. Donahue et al [8] report on the initial testing of niobium liners inserted into steel sleeves. Niobium is one metal that does not appear to dissolve in liquid aluminum [9-10] and should therefore better resist erosion and soldering. A casting trial indicated that the plunger tip experienced a higher level of wear which could be related to distortion of the liner and a loose clearance between the plunger tip and the sleeve liner [8-9].

There is a need to form channels of predetermined shapes for local cooling or heating in a shot chamber in order to achieve an optimal thermal management of the shot sleeve during die casting operation.

Therefore, there is also a need for developing an erosion, oxidation, and wear resistant die casting tooling, including gooseneck for hot-chamber die casting and shot sleeve for cold-chamber die casting applications. Erosion resistant liners are helpful in extending the service life of these die casting tooling. However, the liner surface should be oxidation, wear and erosion resistant. Furthermore, the liner has to be strongly bonded to the bulk material of the die casting tooling in order to avoid tooling distortion which causes excessive wear of the plunger tip and related operational issues.

SUMMARY OF THE INVENTION

In an exemplary embodiment of the present invention, a shrink-fitting process of forming a low-cost, erosion, oxidation, and wear resistant shot chamber of a one-piece structure is provided wherein a metallic liner is metallurgically bonded to a ferrous alloy shot chamber. The process includes preparing a metal liner in the form of a tube, coating the outer surface of the metal tube with a solder material, preparing a ferrous alloy shot chamber and heating it up to desired temperatures, and shrink fitting the shot chamber on the liner tube while the heat of the shot chamber melts the solder material and bonds the shot chamber with the liner tube. Such a shot chamber contains a liner bonded to the bulk material of the shot chamber, is a one-piece structure, and is expected to minimize thermal distortion of the liner during its service for making die castings.

In another embodiment of the present invention, a shrink-fitting process of forming an erosion, oxidation, and wear resistant shot chamber of a one-piece structure is provided wherein channels of desired shapes and layouts are prepared using the interface between the liner and the backside of the shot chamber. The liner and the backside of the shot chamber is bonded by a solder during the shrink-fitting process. Channels thus prepared can be used for the thermal management of the shot sleeve by means of local cooling or heating in order to extend the service life of the shot chamber of a one-piece structure containing a metallic liner. Local cooling or heating can be achieved by passing a fluid or by placing heating elements in the channels.

In yet another embodiment of the present invention, a shrink-fitting process of enhancing metallization using hot dipping is provided. The process includes preparing a metal liner in the form of a tube with its inner surface coated with a layer of erosion-resistant coating, coating the outer surface of the metal liner with a solder material, preparing a ferrous alloy shot chamber and heating it up to desired temperatures, and shrink fitting the shot chamber on the liner tube while the heat of the shot chamber melts the solder material and bonds the shot chamber with the liner tube, forming a composite shot chamber of a one-piece structure. Channels of desired shapes and layouts are prepared using the interface between the liner and the backside of the shot chamber. Such a shot chamber contains a surface protected liner bonded to the bulk material of the shot chamber which is beneficial in minimizing thermal distortion of the refractory liner during its service for making die castings.

In yet another embodiment of the present invention, a shrink-fitting process of forming an erosion, oxidation, and wear resistant shot chamber, either a gooseneck or a shot sleeve, is provided. The process includes the steps of preparing a liner in the form of a tube made of refractory metallic materials with melting temperatures higher than 1600° C., coating the tubular inner surface of the liner with a self-healing coating which has a metallurgical bond to the liner, coating the tubular outer surface of the liner with a solder material, preparing a ferrous alloy shot chamber and heating it up to desired temperatures, and shrink fitting the shot chamber on the liner tube while the heat of the shot chamber melts the solder material and bonds the shot chamber with the liner tube, forming a composite shot chamber of a one-piece structure. Channels of desired shapes and layouts are prepared using the interface between the liner and the backside of the shot chamber. Such a shot chamber produced using the present invention is expected to have a long service life and a minimal thermal distortion during its service for making die castings.

In another embodiment of the present invention, a process of forming an erosion, oxidation, and wear resistant shot chamber is provided wherein the liner material is a refractory metal or its alloys, including niobium, molybdenum, rhenium, tantalum, titanium, or tungsten, and their alloys. The tubular inner surface of the liner is coated with a protective coating which consists of a metal, an alloy, a bonding agent such a solder, or compounds deposited on the liner using physical vapor deposition (PVD), chemical vapor deposition (CVD), hot dipping, thermal spray, or other surface deposition techniques.

In another embodiment of the present invention, a process of forming an erosion, oxidation, and wear resistant shot chamber is provided wherein the surface layer of the liner is a self-healing coating consisting of compounds which can be formed between the liner materials and the molten alloys being processed in the shot chamber. One of such self-healing coatings is an aluminide coating for die casting of aluminum alloys. Damaged coating can be repaired in-situ by the chemical reaction between the liner materials and the molten aluminum alloy being processed in the shot chamber.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

Prior art of fabricating shot chamber has issues with its service life. There are two types of shot chambers: a one-piece structure consisting of a single alloy and a two-piece structure consisting of an inner liner or insert and an outer layer of ferrous alloy wherein the liner is interchangeable and can be removed from the shot chamber if it is damaged. In the shot chamber of a two-piece structure, the liner is not bonded to the bulk of the shot chamber. The term "composite shot chamber" in the present invention refers to the shot chamber of a one-piece structure containing multi-layer materials wherein the layers are metallurgically bonded.

Figure 1:
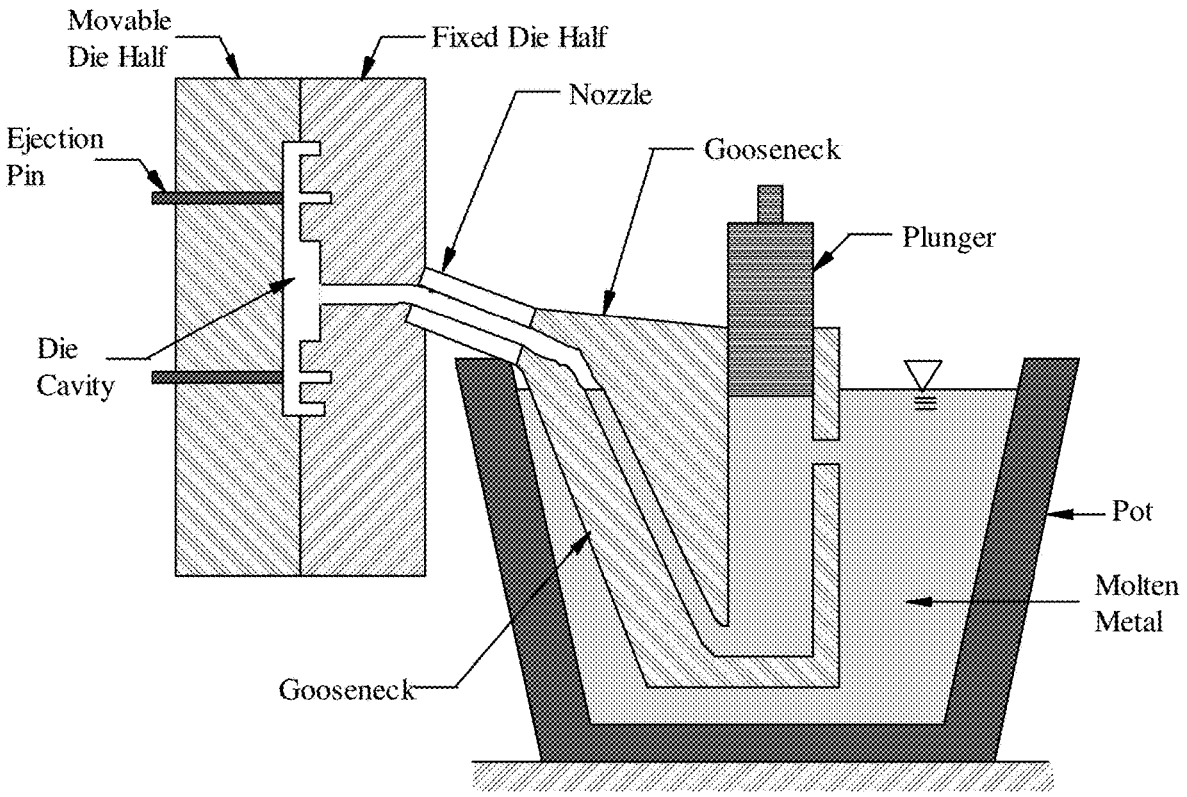
FIG. 1 Prior Art
FIG. 1 schematically represents a hot-chamber die casting process and die tooling associated with the process.
Figure 2:
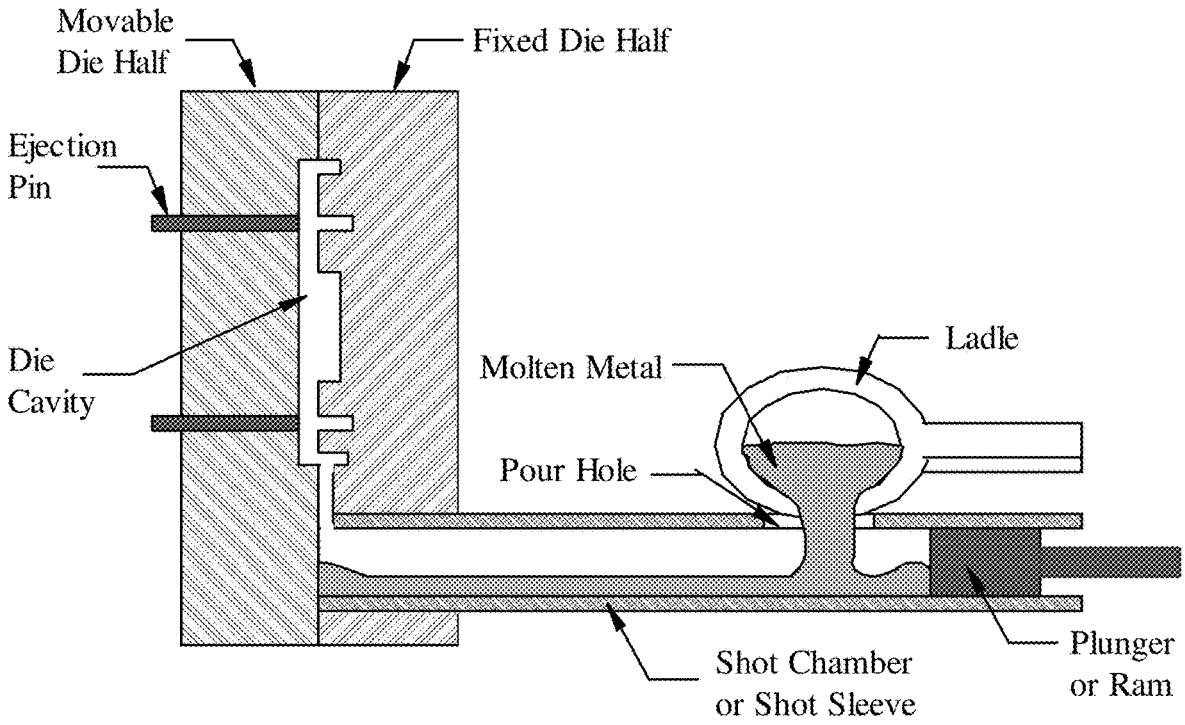
FIG. 2 Prior Art
FIG. 2 schematically represents a cold-chamber die casting process and die tooling associated with the process.
Figure 3A:
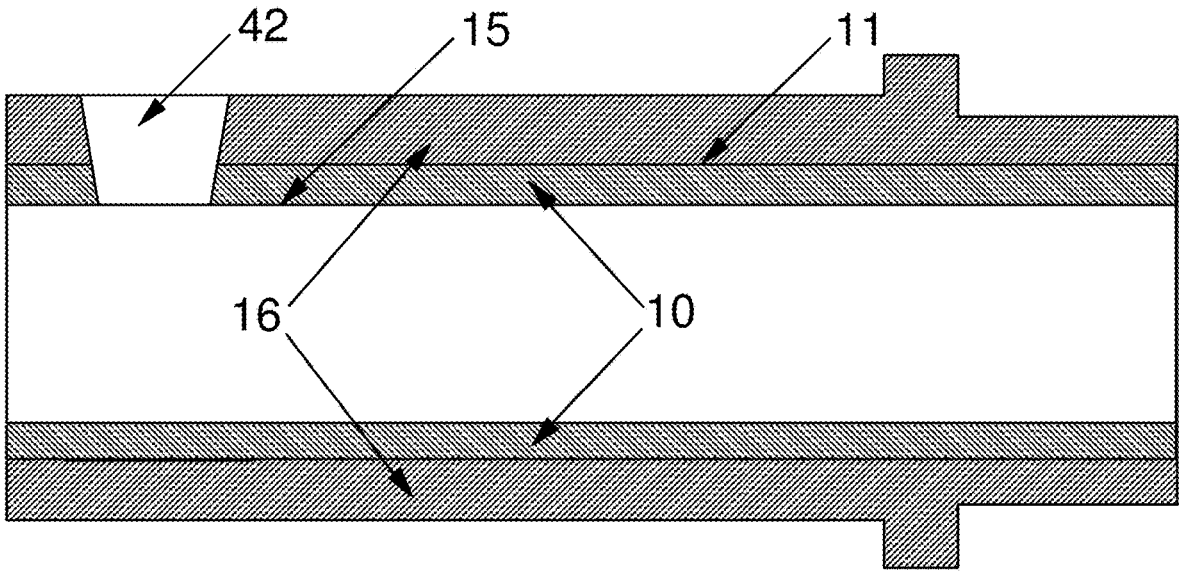
FIGS. 3A and 3B are schematic views of a layout of one embodiment of the present invention.

FIG. 3A illustrates schematically a shot chamber consisting of two layers: an outside layer 16 and an inner layer 10 which is also a liner 10. The liner 10 has a tubular external surface 11 and a tubular inner surface 15. The tubular liner 10 in the prior art fits with the outside layer 16 within a small tolerance (U.S. Pat. No. 9,114,455 to Donahue et al.), i.e., there is no bonding at the interface 11 between the outer layer 16 and the liner 10. The inner layer 10 can be a short liner forming only the internal surface of the shot chamber near the pour hole 42 or a tubular liner covering the entire internal surface of the shot chamber as illustrated in FIG. 3A. The outside layer 16 is usually made of H13 steel in the U.S. die casting industry. The liner 10 is made of H13 steel or a tungsten alloy. In order for the liner to withstand the thermal impact and the resultant thermal distortion, the thickness of the liner 10 is usually greater than an inch, and that of the outer layer is a few inches in the prior art.

In a preferred embodiment, the present invention deals with bonding the liner 10 with the outside layer 16 of the shot chamber using a shrink-fitting process. The inner diameter of the outer layer 16 is smaller than the outer diameter of the liner 10 at room temperatures but is greater than the outer diameter of the liner 10 at a predetermined elevated temperature. The predetermined temperature is calculated using the physical properties of the materials of the liner and the outer layer but is generally lower than the solidus temperature of the outer layer material. The outer layer 16 is heated to the predesigned elevated temperature and shrink fitted on the liner 10. As a result, the outer layer 16 and the liner 10 will be joined together to form a composite shot chamber of a one-piece (unitary) construction. The inner layer 10 can be a short liner forming only the internal surface of the shot chamber near the pour hole 42 or a tubular liner covering the entire internal surface of the shot chamber. Because the liner 10 is bonded to the outer layer 16 at the tubular external surface 11, the liner 10 can be as thin as about 1 millimeter. The outer layer is made of a ferrous alloy. The liner 10 can be made of a metallic alloy or a ceramic material with good resistance to erosion by molten metal and wear by plunger, dissimilar to the ferrous alloy used for making the outer layer of the shot chamber. Alloys suitable for making the liner include alloyed steels and refractory metallic alloys including niobium, molybdenum, rhenium, tantalum, titanium, or tungsten alloys. The liner 10 can also be made of a composite material consisting of a multi-layered structure wherein the internal layer of the liner 10 is made of a refractory material or a ceramic material while the outer layers include a ferrous alloy. The layers in the multi-layered structure are bonded to form a unitary liner. In case the internal layer of the liner is made of a metallic alloy, the tubular inner surface of the metallic liner can be coated with a ceramic coating formed by means including a cementation-packing process, a physical vapor deposition process or a chemical vapor deposition process.

In a preferred embodiment, the present invention deals with soldering the liner 10 with the outside layer 16 of the shot chamber using a shrink-fitting process. The inner diameter of the outer layer 16 is smaller than the outer diameter of the liner 10 at room temperatures but is greater than the outer diameter of the liner 10 at a predetermined elevated temperature. The predetermined temperature is calculated using the physical properties of the materials of the liner and the outer layer but is generally lower than the solidus temperature of the outer layer material. The tubular external surface of the liner 10 is first coated with a layer of solder material. The outer layer 16 is then heated to a predesigned elevated temperature and shrink fitted on the coated liner 10. The heat released from the outer layer 16 melts the solder material on the tubular external surface of liner 10, forming a bond between the liner material and the outer layer material of the shot chamber. As a result, the outer layer 16 and the liner 10 will be joined together to form a composite shot chamber of a one-piece (unitary) construction. The inner layer 10 can be a short liner forming only the internal surface of the shot chamber near the pour hole 42 or a tubular liner covering the entire internal surface of the shot chamber. Because the liner 10 is bonded metallurgically to the outer layer 16 at the tubular external surface 11, the liner 10 can be as thin as about 1 millimeter. The outer layer is made of a ferrous alloy. The liner 10 can be made of a metallic alloy or a ceramic material with good resistance to erosion by molten metal and wear by plunger, dissimilar to the ferrous alloy used for making the outer layer of the shot chamber. Alloys suitable for making the liner include alloyed steels and refractory metallic alloys including niobium, molybdenum, rhenium, tantalum, titanium, or tungsten alloys. The liner 10 can also be made of a composite material consisting of a multi-layered structure wherein the internal layer of the liner 10 is made of a refractory material or a ceramic material while the outer layers include a ferrous alloy. The layers in the multi-layered structure are bonded. In case the internal layer of the liner is made of a metallic alloy, the tubular inner surface of the metallic liner can be coated with a ceramic coating formed by means including a cementation-packing process, a physical vapor deposition process or a chemical vapor deposition process.

The erosion resistance of a steel shot chamber to a molten aluminum alloy decreases substantially with increasing temperature [10]. Uneven temperature distribution in the shot chamber causes chamber distortion, resulting in wear or tear damage to the shot tooling. For thermal management of the shot chamber, channels are drilled into the shot chamber for local cooling or heating. The straight channels drilled into the shot chamber improve thermal management of the chamber but have their limitations in obtaining an optimal temperature distribution.

Figure 3B:
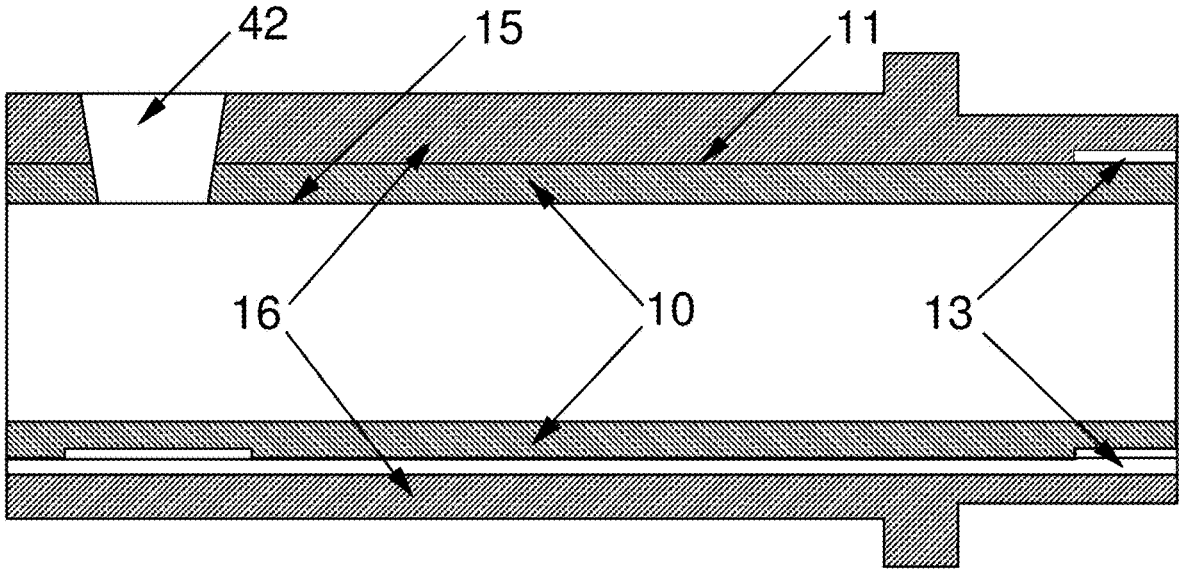

In another preferred embodiment as shown in FIG. 3B, the present invention deals with soldering a liner with the outside layer of a shot chamber using a shrink-fitting process to form a composite shot sleeve containing channels for thermal management. The inner diameter of the outer layer 16 is smaller than the outer diameter of the liner 10 at room temperatures but is greater than the outer diameter of the liner 10 at a predetermined elevated temperature. The predetermined temperature is calculated using the physical properties of the materials of the liner and the outer layer but is generally lower than the solidus temperature of the outer layer material. Prior to the shrink-fitting operation, a channel 13 of a predetermined shape and layout can be built on the outer surface 11 of the liner 10. A number of such channels can be arranged on the tubular external surface 11 of the liner 10 to form an optimal layout of the channels 13 for thermal management of the shot chamber. The channel 13 can be built on the tubular external surface 11 of the liner 10 by conventional operation means including, but is not limited to, 1) machining grooves on the inner surface of the outer layer 16 or the tubular external surface of the liner 10, and 2) building channels 13 on the tubular external surface 11 of the liner 10 to form a channel cavity of a desired shape by welding in 3D printing and machining grooves on the corresponding locations in the outer layer 16 to accommodate the built structure. Channels thus built on the liner 10 can be used to lock the outer layer 16 in place in the machined grooves. The tubular external surface of the liner 10 is then coated with a layer of solder material. The outer layer 16 is being heated to a predesigned elevated and shrink fitted on the coated liner 10. The heat released from the outer layer 16 melts the solder material on the tubular external surface of liner 10, forming a bond between the liner material and the outer layer material of the shot chamber. As a result, the outer layer 16 and the liner 10 will be joined together to form a composite shot chamber of a one-piece (unitary) construction, containing channels between the liner 10 and the outer layer 16. The outer layer 16 is made of a ferrous alloy. The liner 10 can be made of a metallic alloy or a ceramic material with good resistance to erosion by molten metal and wear by plunger, dissimilar to the ferrous alloy used for making the outer layer of the shot chamber. Alloys suitable for making the liner include alloyed steels and refractory metallic alloys including niobium, molybdenum, rhenium, tantalum, titanium, or tungsten alloys. The liner 10 can also be made of a composite material consisting of a multi-layered structure wherein the internal layer of the liner 10 is made of a refractory material or a ceramic material while the outer layers include a ferrous alloy. The layers in the multi-layered structure are bonded. In case the internal layer of the liner is made of a metallic alloy, the tubular inner surface of the metallic liner can be coated with a ceramic coating formed by means including a cementation-packing process, a physical vapor deposition process or a chemical vapor deposition process. The benefit of the present invention as illustrated in FIG. 3B is that channels 13 of a predetermined shape and layout can be conveniently built on the outer surface 11 of the liner 10 prior to shrink-fitting to form a one-piece composite shot chamber. A fluid at a predetermined temperature can then be transported through selected channels for local cooling or heating. Heating elements can also be placed in selected channels for local heating. Such a shot chamber provides means for optimal thermal management of the shot chamber and thus enhancing the service life of the shot chamber and improving the internal quality of die castings made thereof. The fluid suitable for thermal management includes, but is not limited to water, oil, ionic liquid, metallic liquid, mineral liquid, gases, or a mixture of these fluids.

The present invention shown in FIG. 3 allows the use of a thin liner in a one-piece composite shot chamber, which is beneficial not only for improved thermal management but also for reducing the costs of the shot chamber, especially if refractory metals are used for making the liner of the shot chamber.

Recently, thick refractory metal liners have been used in a two-piece shot chamber (U.S. Pat. No. 9,114,455 to Donahue et al.). The service life of a refractory metal liner is much longer than that of H13 steel liner. However, there are also issues associated with the refractory metals.

Refractory metals usually have a poor oxidation resistance [3-4]. Two niobium lined shot sleeves were made according to U.S. Pat. No. 9,114,455 to Donahue et al. One shot sleeve was used for over 6,000 cycles which last longer than H13 shot sleeves, but a dent was formed on the inside surface of the shot sleeve opposite to the pour hole where the molten metal impinged the shot sleeve surface. Erosion did not appear to happen at this area, so the mass loss was most likely due to oxidation. Thermal distortion was another issue. The liner was shrunk fit into the sleeve. There was no bonding between the liner and the H13 steel sleeve. During casting trials, the liner deformed, leading to high level of wear of the liner and the plunger tip.

In a preferred embodiment, the present invention relates to a method for forming an erosion, oxidation, and wear resistant shot chamber for die casting applications. The erosion and wear resistance of the shot chamber are provided by a self-healing coating on the surfaces of a refractory metallic alloy liner. The term "self-healing coating" refers to a coating that, if damaged, can be repaired in-situ by chemical reactions between the liner materials and the molten alloy processed in the chamber, forming similar or dissimilar compounds to that of the original coating on the damaged sites. The purpose of using an initial coating on the refractory metal liner is to protect the liner from oxidation during its fabrication process before the liner is in contact with liquid metal. The initial coating can be damaged by the molten metal in the chamber with the liner. However, as long as the damaged site can be filled or replaced immediately by newly formed materials due to the chemical reaction between the molten metal and the materials on the surface of the liner, a protective layer of coating is formed on the surface of the liner. By such a definition of the self-healing coating, coatings that are suitable for protecting refractory metals from oxidation may be used as the initial coating on the refractory liner. These coatings include but are not limited to silicide and nitride coating, hot dipping and plating of various metals and alloys such as aluminum alloy, tin, silver, and zinc alloy, laser printing of metals and alloys, arc surface alloying, spray forming of metals and alloys, PVD and CVD of compounds.

For a liner made of niobium, tungsten, molybdenum, titanium, and their alloys, aluminizing coating is one of the preferred surface coatings. This is because aluminizing produces a metallurgical bond between the refractory metal liner and aluminides. The bond consists of line compounds at the interface between a refractory metal and molten aluminum. These line compounds have high melting temperatures and thus are resistant to erosion and soldering by molten aluminum [5]. As a line compound, its composition falls within a very narrow range as diffusion of elements across this compound becomes difficult because composition difference is the driving force for elemental diffusion and erosion is a diffusion-controlled process. Furthermore, the line compound usually has high hardness which is good in resisting wear in the shot chamber by the plunger. Niobium, for instance, reacts with molten aluminum and forms a line compound, $NbAl_3$. The melting temperature of this compound is 1760° C., much higher than the melting temperature of aluminum (660° C.). Aluminum at the external surface of the compound is resistant to oxidation at elevated temperatures. This line compound, if damaged on the liner surface, can be replaced in-situ with newly formed line compounds in the next cycle of die casting when the liner is in contact with molten metal. Aluminum metal can be deposited on niobium alloys (or molybdenum and its alloys) using hot dipping, chemical vapor deposition, laser printing, fused salt processes, and physical vapor deposition. Aluminum deposited on the refractory metal can then heat treated to improve the formation of aluminides.

Yet in another preferred embodiment, the present invention relates to a method for forming an erosion, oxidation, and wear resistant shot chamber for die casting applications. The liner of a refractory metal is first coated with an oxidation resistant layer. The outside surfaces of the coated liner are then coated with another layer of bonding materials such as solders. The bulk material of a shot chamber is heated to elevated temperatures and shrink fitted on the outside surfaces of the coated liner. The heat from the bulk material melts the bonding materials, forming a metallurgical bond between the liner material and the bulk material of the shot chamber.

For hot-chamber die casting, castings of composite gooseneck consisting of refractory metallic alloy liner, or even ceramic liner, has not been tested in the past. This is partly due to the fact that conventional refractory materials are ceramic materials that are not capable of withstanding the thermal shock of contacting molten ferrous alloys such as steels and cast irons. Refractory metals, such as niobium alloys, experience rapid oxidation at temperatures above 400 to 500° C. By 1100° C., the low oxidation resistance of refractory metals can completely preclude their use in air [3-4]. Therefore, according to conventional wisdom, it is unreasonable to cast liquid iron or steel, usually at temperatures of above 1300° C., on niobium alloys. Furthermore, niobium has been an alloying element added in molten cast iron or steel to improve their mechanical properties, indicating that niobium can readily dissolve into molten ferrous alloys. Such a phenomenon prevents people from attempting to cast a composite gooseneck containing a thin liner of refractory metal.

For cold-chamber die casting, conventional methods for fabricating a shot sleeve with a refractory metal liner involve using a rough chamber of wrought H13 steel, machining to expand a portion of its internal diameter, and inserting the liner tightly into the shot sleeve. The liner has to be thick enough to reduce thermal distortion during its service because the liner is not bonded to the bulk material of the chamber. Refractory metals are expensive, so the use of a thick refractory metal increases the costs of the chamber substantially. A shot sleeve with a niobium liner was built and tested [8-9]. After this shot sleeve was used for around 300 shots or cycles, the liner was pushed towards the dies/molds due to its plastic deformation, leaving a gap at the ram end. Such a gap decreases the service life of the ram. It is also a safety concern. Another issue is the low hardness of the refractory liner which leads to severe wear of the liner during service. Furthermore, premium H13 steel with strict heat treatment procedures has to be used as the bulk material for the chamber. H13 steel is also more expensive than conventional high strength cast steels.

This invention teaches the use of refractory metal liner with a strong metallurgical bond to the bulk material of the shot chamber. The thermal shock of the molten metal during die casting is applied on the refractory metal liner. The bulk material of the chamber, which is buffered by the liner, is not in direct contact with the molten metal and thus experiences much less thermal shock. As a result, the present invention enables the use of low cost steels with higher strength but lower thermal shock resistance than the bulk materials for the shot sleeve. The present invention also teaches the use of a "self-healing" wear resistant coating that has a metallurgical bond to the refractory liner. Such a coating, if damaged, can be repaired in-situ by chemical reactions between the molten metal and the liner. The molten metal is likely to fill the damaged sites on the liner. The filled metal will have enough time to react with the liner materials during the following cycles of die casting operations. The reaction products between the liner material and the molten metal are intermetrallics. These intermetallic phases are hard enough to resist wear by the plunger and erosion by the molten metal.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. J. Song, T. DenOuden, and Q. Han, "Soldering Analysis of Core Pins", *NADCA Transactions* 2011, T11-062.
2. Z. Liu, Q. Han, and J. Li, "Ultrasound Assisted in situ Technique for the Synthesis of Particulate Reinforced Aluminum Matrix Composites," *Composites Part B: Engineering*, vol. 42, 2011, pp. 2080-2084.
3. C. L. Briant, "The properties and Uses of Refractory Metals and Their Alloys," *High Temperature Silicides and Refractory Alloys*, C. L. Briant et al. eds., Materials Research Society Symposium Proceedings, vol. 322, 1994, pp. 305-314.
4. J. B. Lambert, "Refractory Metals and Alloys," ASM Handbook, vol. 2, 1990, pp. 557-565.
5. Q. Han, and S. Viswanathan, "Analysis of the Mechanism of Die Soldering in Aluminum Die Casting", *Metallurgical and Materials Transaction A*, vol. 34A, (2003), pp. 139-146.
6. Y. Chu, P. Cheng, and R. Shivpuri "A Study of Erosive Wear in Die Casting Dies: Surface Treatments and Coatings," *NADCA Transactions* 1993, pp. 361-371.
7. Q. Han, "Mechanism of Die Soldering during Aluminum Die Casting," *China Foundry*, vol. 12 (2), (2015), pp. 136-143.

8. R. Donahue, S. Knickel, P. Schneider, M. Witzel, J. Melius, and A. Monroe, "Performance of Shot Sleeve with Different Refractory Metal Liners in Casting of Structural Aluminum Die Casting Alloy 362", *NADCA Transactions* 2014, T14-011.
9. R. Donahue, "Avoiding Washout in Shot Sleeve When Used with Low Iron, Structural Aluminum Die Casting Alloys", *NADCA Transactions* 2013, T13-051. A. B. William, and S. Midson, *Shot System Components User's Guide*, NADCA Publication: 525, NADCA 2016.
10. Q. Han, C. Vian, and J. Good, "Application of Refractory Metals to Facilitate Hot Chamber Aluminum Die Casting", International Journal of Metalcasting, vol. 15 (2), pp. 411-416.

What is claimed is:

1. A method for forming an erosion, oxidation, and wear resistant composite shot chamber for die casting processes, the method comprising the steps of:

preparing a liner with a minimum wall thickness of about 1 mm as an internal layer of said shot chamber, the liner having a tubular external surface and a tubular inner surface;

preparing an outer layer of said shot chamber from a ferrous alloy having an inner diameter smaller than an external diameter of said liner at room temperature and heating said outer layer up to a predetermined temperature to make the inner diameter of said outer layer greater than the external diameter of the liner; and shrink fitting the outer layer of the shot chamber on the liner, whereby said outer layer and said liner will be joined together to form a composite shot chamber of a one-piece (unitary) construction.

2. A method of claim 1 further including a step of coating the tubular external surface of the liner with a layer of metallic solder material which melts and solders the outer layer with the liner while the outer layer is shrink fitted on the liner and cools to room temperature.

3. A method of claim 1, wherein the liner is made of a ceramic material or a metallic alloy including a steel and a refractory metallic alloy selected from a group of alloys including niobium, molybdenum, rhenium, tantalum, titanium, or tungsten alloys.

4. A method of claim 1, wherein the liner is made of a multi-layered structure with its inner layer made of a refractory metallic alloy or a ceramic material and its outer layer made of a ferrous alloy, the layers being bonded to form a unitary liner.

5. A method of claim 1, wherein the tubular inner surface of a metallic liner is coated with a ceramic coating formed by means including a cementation-packing process, a physical vapor deposition process, or a chemical vapor deposition process.

6. A method of claim 1, wherein the tubular inner surface of a refractory metallic liner is coated with a self-healing coating.

7. A method of claim 6, wherein said self-healing coating is a metallized coating formed by means including hot plating, cementation-packing, laser-printing, thermal spraying, and arc surface alloying.

8. A method of claim 1, wherein said predetermined temperature is lower than the solidus temperature of the ferrous alloy used for making the outer layer of the shot chamber.

9. A method for forming an erosion, oxidation, and wear resistant composite shot chamber for die casting processes, the method comprising the steps of:

preparing a liner with a minimum wall thickness of about 1 mm as an internal layer of said shot chamber, the liner having a tubular external surface and a tubular inner surface;

preparing an outer layer of said shot chamber from a ferrous alloy;

forming at least one channel of a predetermined shape and layout by machining at a junction of the liner and the outer layer of said shot chamber;

coating the tubular external surface of the liner with a layer of metallic solder material;

heating said outer layer up to a predetermined temperature; and shrink fitting the outer layer of the shot chamber on the liner using heat in the outer layer to melt the solder material and to solder the outer layer with the liner, and whereby said outer layer and said liner will be joined together to form a composite shot chamber of a one-piece (unitary) construction and multi-layered materials and containing the at least one channel for passing a fluid or for placing heating elements for thermal management of the shot chamber during die casting operation.

10. A method of claim 9, wherein the liner is made of a ceramic material or a metallic alloy including a steel or a refractory metallic alloy selected from a group of alloys including niobium, molybdenum, rhenium, tantalum, titanium, or tungsten alloys.

11. A method of claim 9, wherein the liner is made of a multi-layered structure with its inner layer made of a refractory metallic alloy or a ceramic material and its outer layer made of a ferrous alloy, the layers being bonded to form a unitary liner.

12. A method of claim 9, wherein the tubular inner surface of a metallic liner is coated with a ceramic coating formed by means including a cementation-packing process, a physical vapor deposition process, or a chemical vapor deposition process.

13. A method of claim 9, wherein the tubular inner surface of a refractory metallic liner is coated with a self-healing coating.

14. A method of claim 13, wherein said self-healing coating is a metallized coating formed by means including hot plating, cementation-packing, laser-printing, thermal spraying, and arc surface alloying.

15. A method of claim 9, wherein said predetermined temperature is lower than the solidus temperature of the ferrous alloy used for making the outer layer of the shot chamber.

16. A method of claim 9, wherein an inside diameter of the outer layer of the shot chamber is slightly larger than the outside diameter of the liner at said predetermined temperature but is smaller than an outside diameter of the liner at room temperature.

17. A method of claim 9, wherein the fluid for thermal management of the shot chamber includes water, oil, ionic liquid, metallic liquid, mineral liquid, gases, or a mixture thereof.

* * * * *